United States Patent [19]

DeNigris et al.

[11] 4,103,126

[45] Jul. 25, 1978

[54] SNAP ACTION SWITCH

[75] Inventors: Ernest Gerard DeNigris, Colts Neck; Merle Victor Olsen, Lincroft, both of N.J.

[73] Assignee: Bell Telephone Laboratories, Incorporated, Murray Hill, N.J.

[21] Appl. No.: 687,694

[22] Filed: May 19, 1976

[51] Int. Cl.[2] ..... H01H 5/14

[52] U.S. Cl. ..... 200/67 C; 200/67 R; 200/153 K; 200/339

[58] Field of Search ..... 200/67 C, 67 B, 67 BG, 200/67 R, 339, 337, 153 K, 315, 83 S, 83 R, 67 A

[56] References Cited

U.S. PATENT DOCUMENTS

| | | | |
|---|---|---|---|
| 549,268 | 11/1895 | Haskins | 200/67 C |
| 582,840 | 5/1897 | Wright | 200/67 C |
| 1,682,007 | 8/1928 | Freeman | 200/340 |
| 2,073,141 | 3/1937 | Chaney | 200/153 K |
| 2,247,231 | 6/1941 | Getchell | 200/67 A X |
| 2,754,688 | 7/1956 | Barecki | 200/67 A X |

FOREIGN PATENT DOCUMENTS

| | | | |
|---|---|---|---|
| 824,164 | 7/1937 | France | 200/339 |
| 1,259,356 | 1/1972 | United Kingdom | 200/339 |

*Primary Examiner*—J. V. Truhe
*Assistant Examiner*—Mark H. Paschall
*Attorney, Agent, or Firm*—David H. Tannenbaum; James M. Graziano

[57] ABSTRACT

The disclosed switch mechanism consists of two toggle arm type linkages connected to a switch actuator, powered by a dual torsion bar spring, each linkage working in opposition to the other. Thus, a net resultant force is exerted on the switch actuator locating the associated switch mechanism in either of two stable positions with the net resultant force being equal to the difference between the forces generated by the two torsion bar spring arms and applied by the two toggle arms to the switch actuator.

14 Claims, 4 Drawing Figures

SNAP ACTION SWITCH

BACKGROUND OF THE INVENTION

1. Field of the Invention

This invention relates to snap action switches and is particular to rocker type snap action switches.

2. Description of the Prior Art

Snap action switches are known in the prior art and these switch mechanisms rely on the use of detents or overcenter positioning to obtain a snap action mechanism. The disadvantage of detents and overcenter positioning is that a significant area under the switch actuator is occupied by the switch mechanism itself. Thus, a minimal area is available for the electrical contacts, unless a fairly high profile switch housing is used. This is especially true of the more complex snap action switch mechanisms. Additionally, snap action switch mechanism designs are specialized and not easily adapted to provide other than a snap action function.

Accordingly, the object of the invention is to provide a simple snap action switch mechanism capable of being mounted in a low profile switch housing in order to avoid the problems indicated.

Another object of the invention is to provide a switch mechanism that can be easily adapted to perform other functions. Whereas a basic snap action switch mechanism is disclosed, it is easily modified to provide a momentary operate switch mechanism, or a preferred position snap action switch mechanism which requires the application of a greater force on the switch actuator to operate the switch in one direction than the other.

SUMMARY OF THE INVENTION

The general object and additional related objectives are achieved in accordance with the principles of the invention by the disclosed switch mechanism consisting of two toggle arm type linkages connected to a switch actuator powered by a dual torsion bar spring, each linkage working in opposition to the other. The arrangement of the toggle arms is such that although the forces obtainable from each of the two torsion bar spring arms are equal in magnitude, the direction of the forces applied to the two opposing toggle arms as well as the effective lever ratio of the two opposing toggle arms change continually as the switch actuator is rotated about its pivot point. Thus, a net resultant force is exerted on the switch actuator, locating the associated switch mechanism in either of two stable positions with the net resultant force being equal to the difference between the forces obtained from the two torsion bar spring arms and applied by their respective toggle arms to the switch actuator.

DESCRIPTION OF THE PREFERRED EMBODIMENT

Figure 1:
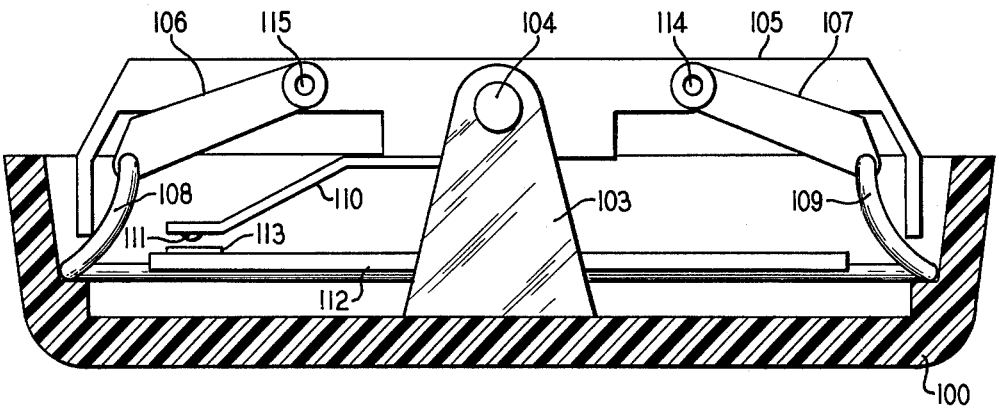
FIG. 1 is a cross section view of the snap action switch mechanism assembly with the switch actuator located midway between the two stable positions.

As shown in FIG. 1, the snap action switch mechanism of this invention is mounted in a somewhat rectangular low profile fixed housing 100. Mounted in and attached to fixed housing 100 is vertical frame element 103 which supports pivot pin 104 that serves as a pivotal mount for rocker type switch actuator 105. Toggle arms 106 and 107 are pivotally attached to switch actuator 105 by means of pivot pins 114 and 115, one on either side of and equidistant from pivot pin 104. Toggle arms 106 and 107 are mounted in opposition to each other in that a force applied to the end of one toggle arm will tend to rotate switch actuator 105 in a direction opposite that caused by a duplicate force applied to the corresponding end of the other toggle arm.

Figure 4:
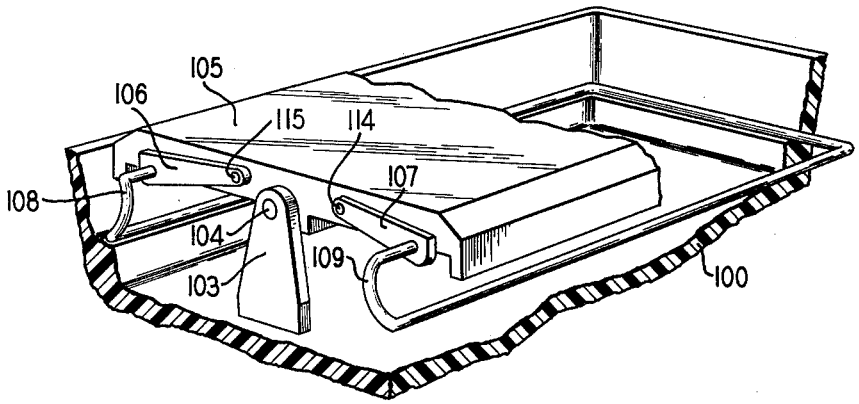
FIG. 4 is a sketch in front perspective view of the snap action switch mechanism mounted in a housing.

The other end of each toggle arm 106 and 107 is pivotally attached to torsion bar spring arms 108 and 109 respectively. Torsion bar spring arms 108 and 109 are in turn attached to fixed housing 100 by being rigidly mounted in a notch in fixed housing 100. Torsion bar spring arms 108 and 109 need not be attached to fixed housing 100, as long as they are maintained in a fixed relationship to vertical frame element 103. In fact, a dual torsion bar spring attached to vertical frame element 103 may be used. However, the disclosed embodiment demonstrates the operation of the switch mechanism with torsion bar spring arms 108 and 109 attached to fixed housing 100 as shown more clearly in FIG. 4, which is a front perspective view of the snap action switch mechanism.

In the disclosed embodiment, toggle arms 106 and 107 are of equal dimensions and torsion bar spring arms 108 and 109 are exact duplicates of each other, each capable of generating forces that, for a given deflection, are equal in magnitude to each other. Thus, the disclosed switch mechanism is symmetric about a vertical line drawn through pivot pin 104.

Numerous contact configurations can be implemented with this switch mechanism. However, for simplicity only a straightforward contact configuration is disclosed in the preferred embodiment. The disclosed contact arrangement comprises contact 111 mounted on contact spring 110 which is attached to switch actuator 105. Contact 113 is disposed opposite to contact 111 and is mounted on circuit board 112. Circuit board 112, in turn, is rigidly attached to vertical frame element 103. Thus, when switch actuator 105 is rotated counterclockwise about pivot pin 104, contact spring 110 carries contact 111 downward to impinge on contact 113 forcing contacts 111 and 113 into electrical contact. It is obvious from this description that, alternatively, numerous contact springs can be attached to switch actuator 105 on either side of or on both sides of pivot pin 104. The contact configurations associated with these contact springs may perform any of the well known functions of make, break, transfer of continuity, etc. in any number of ways. The implementation of various contact arrangements to be used with the disclosed switch mechanism is well known in the art and need not be discussed herein.

Figure 2:
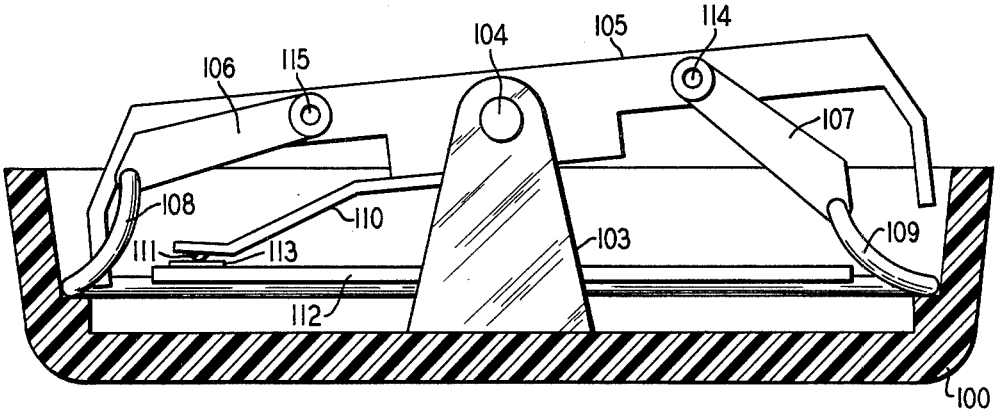
FIG. 2 is a cross section view of the snap action switch mechanism assembly shown in FIG. 1 while the switch actuator is located in one of the two stable positions.

In FIG. 2, the switch mechanism is shown located in one of the two stable positions. Toggle arm 107 is extended to form a nearly straight line with torsion bar spring arm 109 while opposing toggle arm 106 is flexed to form an obtuse angle with torsion bar spring arm 108. The leverage ratio of extended toggle arm 107 is greater than that of flexed toggle arm 106 and a greater force is transmitted to switch actuator 105 from torsion bar spring arm 109 than from torsion bar spring arm 108. Thus, a net resultant force is exerted on switch actuator 105 at pivot pin 114 in an upward direction tending to cause a counterclockwise rotation of switch actuator 105, which causes a downward force on contact spring 110 attached to switch actuator 105, forcing contacts 111 and 113 into electrical contact. The net resultant force on switch actuator 105 will also maintain the switch mechanism in this one of two stable positions.

To operate the switch mechanism to the other stable position, the net resultant force must be overcome. This is accomplished by applying an external force in the downward direction to switch actuator 105 to the right of pivot pin 104, causing switch actuator 105 to rotate clockwise about pivot pin 104. The clockwise rotation of switch actuator 105 extends flexed toggle arm 106 to form a nearly straight line with torsion bar spring arm 108 while flexing previously extended toggle arm 107 to form an obtuse angle with torsion bar spring arm 109, thus changing the lever ratio of both toggle arms and also changing the direction of the forces applied to both toggle arms. Once switch actuator 105 is rotated past the null point (which is shown in FIG. 1), wherein both toggle arms are equally flexed, the opposing toggle arms apply a net resultant force to switch actuator 105 at pivot pin 115 in an upward direction, tending to cause a clockwise rotation of switch actuator 105. This force operates as previously described to rotate switch actuator 105 in a clockwise direction until the switch mechanism is located in the other stable position.

Figure 3:
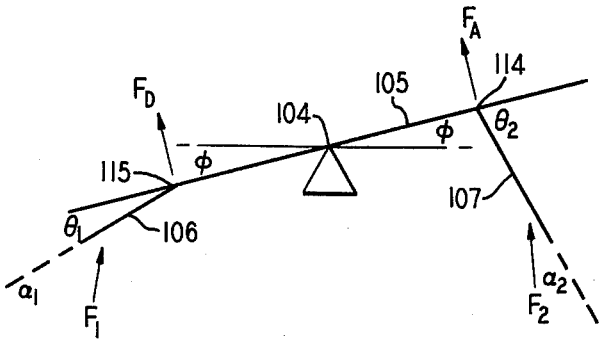
FIG. 3 is a force diagram of the snap action switch mechanism shown in FIG. 2.

Force Diagram — FIG. 3

The system shown in FIG. 3 presents a simplified diagram of the switch mechanism shown in FIG. 2. Switch actuator 105 is connected to toggle arms 106 and 107 by pivot pins 115 and 114 respectively. Torsion bar spring 108 (not shown) applies a force $F_1$ to toggle arm 106 while torsion bar spring 109 (not shown) applies a force $F_2$ to toggle arm 107. The only component of force $F_1$ that is of interest is that which is applied along the length of toggle arm 106. If force $F_1$ is applied to toggle arm 106 at an angle of $\alpha_1$, the component along arm 106 is $F_1/\cos\alpha_1$. Likewise, the component of force $F_2$ along the length of toggle arm 107 is $F_2/\cos\alpha_2$.

Toggle arms 106 and 107 apply their respective forces to switch actuator 105, but the only components of these forces that will cause a rotation of switch actuator 105 about a pivot pin 104 are the components perpendicular to the top of switch actuator 105, forces $F_D$ and $F_A$ respectively. From the geometry, it is evident that $$F_A = \frac{F_2 \sin\theta_2}{\cos\alpha_2}$$

and $$F_D = \frac{F_1 \sin\theta_1}{\cos\alpha_1}$$

However, $$\theta_1 = \alpha_1 - \phi$$

$$\theta_2 = \alpha_2 + \phi$$

Also, for very small spring deflections, as is true in the preferred embodiment, $F_1 = F_2$. Therefore, $$F_A = F_1(\tan\alpha_2 \cos\phi + \sin\phi)$$

$$F_D = F_1(\tan\alpha_1 \cos\phi - \sin\phi).$$

As shown in FIGS. 2 and 3, switch actuator 105 is deflected from the horizontal so $$\phi > 0$$

and $$\alpha_1 > \alpha_2.$$

Thus, $$\tan\alpha_1 > \tan\alpha_2$$

$$\sin\phi > 0$$

and $$F_A > F_D.$$

Therefore, it is evident that a net resultant force equal to the difference between force $F_A$ and $F_D$ is applied to switch actuator 105 at pivot pin 114 in the direction shown by the arrow labeled $F_A$ in FIG. 3. causing switch actuator 105 to rotate counterclockwise about pivot pin 104. This counterclockwise rotation further increases the difference between $\alpha_1$ and $\alpha_2$ as well as increasing $\phi$, thereby increasing the difference between $F_D$ and $F_A$. These changes in $\alpha_1$, $\alpha_2$ and $\phi$ increase the net resultant force and the counterclockwise rotation of switch actuator 105 speeds up until its motion is arrested by a mechanical stop (not shown) and the switch mechanism is located in one of the two stable positions. In this stable position, contact 111, mounted on contact spring 110 which is attached to switch actuator 105, impinges on contact 113 mounted on circuit board 112 attached to vertical frame element 103 and the electrical circuit is completed.

Momentary Operate Switch

While a basic snap action bistable switch mechanism has been disclosed, it can easily be converted to a monostable or momentary operate switch mechanism. Deletion of one of the toggle arms, such as toggle arm 106, would completely eliminate one of the opposing forces. Thus, if toggle arm 106 were removed, $F_D = 0$, so the only force applied by the torsion bar spring to switch actuator 105 is force $F_A$ and switch actuator 105 will have only one stable location, that shown in FIG. 2. As previously described, the switch mechanism can be operated to the other position by the application of an external force, but once the external force is removed, the switch mechanism will automatically relocate switch actuator 105 to the single stable location.

From the foregoing description, it is evident that while a low profile switch mechanism configuration was disclosed, there are a multitude of other configurations that can be implemented by the application of the principles of the invention. The various parameters, such as spring tension, toggle arm length, distance from pivot pin 104 that toggle arms 106 and 107 are attached to switch actuator 105, can be modified to change the values of stroke length, net resultant force, contact pressure over a wide range of operational limits. Additionally, other features may be obtained by departing from the basic symmetry of the disclosed switch mechanism. An example of this is a preferred position switch wherein a greater external force is required to locate the switch mechanism in one position than the other. This preferred position switch can be attained by having one spring with a greater spring tension than the other or by departing from the equidistant attachment of toggle arms 106 and 107 to switch actuator 105.

SUMMARY

While a specific embodiment of the invention has been disclosed, variations in structural detail within the scope of the appended claims are possible, and are contemplated. There is no intention of limitations to what is contained in the abstract of the disclosure as herein presented. The above described switch mechanism, contact arrangements, spring configurations are only illustrative of the application of the principles of the invention. Other arrangements may be devised by those skilled in the art without departing from the spirit and scope of the invention.

What is claimed is:

1. A switch mechanism comprising:

a frame element;

a switch actuator pivotally attached to said frame element;

first arm means one end of which is connected to said switch actuator and laterally displaced to one side of said pivotal attachment;

second arm means one end of which is connected to said switch actuator and laterally displaced to the other side of said pivotal attachement from said first arm means connection and in force opposition to said first arm means;

first torsion spring means pivotally connected to the other end of said first arm means for applying a first force to said switch actuator through said first arm means;

second torsion spring means pivotally connected to the other end of said second arm means for applying a second force opposing said first force to said switch actuator through said second arm means; and said switch actuator having two stable positions, each stable position having one arm means extended in a straight line relationship with respect to the associated said torsion spring means and one arm means flexed in an angular relationship with respect to the associated said torsion spring means and wherein said applied forces in said two stable positions are unequal serving to maintain said switch actuator in an established stable position.

2. The invention of claim 1 wherein:

said first applied force and said second applied force are functionally related to the angular displacement of said switch actuator from the horizontal;

said first applied force is greater than said second applied force when said switch actuator is displaced from the horizontal in the clockwise direction, locating said switch actuator in a first stable position; and said second applied force is greater than said first applied force when said switch actuator is displaced from the horizontal in the counterclockwise direction, locating said switch actuator in a second stable position.

3. The invention of claim 2 wherein said one end of said first and said second arm means are pivotally connected to said switch actuator.

4. The invention of claim 3 wherein said spring means comprises a torsion bar spring maintained in a fixed relationship to said frame element and co-planar with said switch actuator.

5. A snap action switch comprising:

a switch mechanism comprising:

a frame element;

a switch actuator pivotally attached to said frame element;

first arm means one end of which is connected to said switch actuator and laterally displaced to one side of said pivotal attachment;

second arm means one end of which is connected to said switch actuator and laterally displaced to the other side of said pivotal attachment from said first arm means connection and in force opposition to said first arm means;

first torsion spring means pivotally connected to the other end of said first arm means for applying a first force to said switch actuator through said first arm means;

second torsion spring means pivotally connected to the other end of said second arm means for applying a second force opposing said first force to said switch actuator through said second arm means;

said switch actuator having two stable positions, each stable position having one arm means extended in a straight line relationship with respect to the associated said torsion spring means and one arm means flexed in an angular relationship with respect to the associated said torsion spring means and wherein said applied forces in said two stable positions are unequal serving to maintain said switch actuator in an established stable position;

a first contact attached to said frame element; and a second contact attached to said switch actuator disposed opposite said first contact, wherein said second contact impinges upon said first contact as said switch actuator is rotated about its pivot point to one of said two stable positions.

6. A switch mechanism comprising:

a frame element;

a switch actuator pivotally attached to said frame element;

arm means, one end of which is connected to said switch actuator and laterally displaced to one side of said pivotal attachment; and torsion spring pivotally attached to the other end of said arm means for applying a force to said switch actuator via said arm means wherein said force locates said switch actuator in a stable position.

7. The invention of claim 6 wherein said one end of said arm means is pivotally connected to said switch actuator.

8. The invention of claim 7 wherein said spring means comprises a torsion bar spring maintained in a fixed relationship to said frame element and co-planar with said switch actuator.

9. A snap action switch comprising:

a switch mechanism comprising:

a frame element;

a switch actuator pivotally attached to said frame element;

arm means, one end of which is connected to said switch actuator and laterally displaced to one side of said pivotal attachment;

torsion spring means attached to the other end of said arm means for applying a force to said switch actuator via said arm means wherein said force locates said switch actuator in a stable position;

a first contact attached to said frame element; and a second contact attached to said switch actuator disposed opposite said first contact, wherein said second contact impinges upon said first contact as said switch actuator is rotated about its pivot point away from said stable position.

10. A switch mechanism comprising:

a frame element;

a switch actuator pivotally attached intermediate between its extremities to said frame element;

first arm means, one end of which is connected to said switch actuator and laterally displaced to one side of said pivotal attachment;

a first torsion spring means connected to the other end of said first arm means for applying a first force to said switch actuator through said first arm means;

second arm means, one end of which is connected to said switch actuator in force opposition to said first arm means and laterally displaced to the other side of said pivotal attachment from said first arm means connection and equidistant from said pivotal attachment as said first arm means connection;

second torsion spring means connected to the other end of said second arm means for applying a second force opposing said first force to said switch actuator through said second arm means; and said switch actuator having two stable positions, each stable position having one arm means extended in a straight line relationship with respect to the associated said torsion spring means and one arm means flexed in an angular relationship with respect to the associated said torsion spring means and wherein said applied forces in said two stable positions are unequal serving to maintain said switch actuator in an established stable position.

11. The invention of claim 10 wherein said one end of said first and said second arm means are pivotally connected to said switch actuator.

12. The invention of claim 11 wherein:

the force generated by said first spring means is equal in magnitude to the force generated by said second spring means; and the inequality of said first applied force and said second applied force is caused by the disparity between the angular relationship between the force generated by said first spring means, said first arm means, said switch actuator and the angular relationship between the force generated by said second spring means, said second arm means, and said switch actuator.

13. The invention of claim 12 wherein:

said first applied force is greater than said second applied force when said switch actuator is displaced from the horizontal in the clockwise direction, locating said switch actuator in a first stable position; and said second applied force is greater than said first applied force when said switch actuator is displaced from the horizontal in the counterclockwise direction, locating said switch actuator in a second stable position.

14. A snap action switch comprising:

a switch mechanism comprising:

a frame element;

a switch actuator pivotally attached intermediate between its extremities to said frame element;

first arm means, one end of which is connected to said switch actuator and laterally displaced to one side of said pivotal attachment;

a first torsion spring means connected to the other end of said first arm means for applying a first force to said switch actuator through said first arm means;

second arm means, one end of which is connected to said switch actuator in force opposition to said first arm means and laterally displaced to the other side of said pivotal attachment from said first arm means connection and equidistant from said pivotal attachment as said first arm means connection;

second torsion spring means connected to the other end of said second arm means for applying a second force opposing said first force to said switch actuator through said second arm means;

said switch actuator having two stable positions, each stable position having one arm means extended in a straight line relationship with respect to the associated said torsion spring means and one arm means flexed in an angular relationship with respect to the associated said torsion spring means and wherein said applied forces in said two stable positions are unequal serving to maintain said switch actuator in an established stable position;

a first contact attached to said frame element; and a second contact attached to said switch actuator disposed opposite said first contact, wherein said second contact impinges upon said first contact as said switch actuator is rotated about its pivot point to one of said two stable positions.

* * * * *